US005295674A

United States Patent [19]

Zoltner

[11] Patent Number: 5,295,674

[45] Date of Patent: Mar. 22, 1994

[54] HIGH CAPACITY ENVELOPE STACKER APPARATUS

[75] Inventor: John D. Zoltner, Rochester, N.Y.

[73] Assignee: Xerox Corporation, Stamford, Conn.

[21] Appl. No.: 62,647

[22] Filed: May 14, 1993

[51] Int. Cl.[5] ..... B65H 29/00

[52] U.S. Cl. ..... 271/2; 271/177; 271/215

[58] Field of Search ..... 271/2, 177, 207, 213-215, 271/903, 180, 181, 178

[56] References Cited

U.S. PATENT DOCUMENTS

| | | | |
|---|---|---|---|
| 1,269,673 | 6/1918 | Armstrong | 271/178 |
| 3,661,384 | 5/1972 | Morton | 271/177 |
| 4,045,017 | 8/1977 | Lundblad | 271/181 |
| 4,088,314 | 5/1978 | Phillips | 271/178 |
| 4,106,766 | 8/1978 | Stefansson | 271/181 |
| 4,273,491 | 6/1981 | Roux | 271/214 |
| 4,362,100 | 12/1982 | Wu et al. | 101/233 |
| 4,388,008 | 6/1983 | Greene et al. | 400/578 |
| 4,674,934 | 6/1987 | Honger | 271/177 |
| 4,930,762 | 6/1990 | Kitchens | 271/11 |
| 5,139,250 | 8/1992 | Zoltner | 271/2 |
| 5,201,504 | 4/1993 | Fallos et al. | 271/2 |

FOREIGN PATENT DOCUMENTS

| | | | |
|---|---|---|---|
| 0054708 | 6/1982 | European Pat. Off. | B41J 13/12 |
| 270623 | 2/1914 | Fed. Rep. of Germany | 271/177 |
| 477085 | 4/1927 | Fed. Rep. of Germany | 271/177 |
| 682707 | 10/1939 | Fed. Rep. of Germany . | |
| 0089155 | 7/1980 | Japan | 271/178 |
| 401929 | 11/1933 | United Kingdom | 271/2 |

*Primary Examiner*—H. Grant Skaggs

[57] ABSTRACT

A high capacity envelope stacker accepts envelopes from a source in a planar configuration, pivots each envelope individually on either of its long edge axis so that it is stacked on its long edge, and then restrains the envelope on its two faces so that the stack of envelopes as a whole are stacked 1—N exactly as they arrive from the printer up to about 500 envelopes.

10 Claims, 5 Drawing Sheets

HIGH CAPACITY ENVELOPE STACKER APPARATUS

Priority of now abandoned U.S. application Ser. No. 07/887,950, filed May 26, 1992 by John D. Zoltner and entitled High Capacity Envelope Stacker Apparatus is hereby claimed in this continuation-in-part application.

This invention is directed to a stacker for stacking envelopes received from a machine that has placed images on the envelopes, and more particularly, to an envelope stacking apparatus that stacks envelopes on long edges thereof.

An efficient and cost effective way to neatly stack a high capacity (more than 40 or 50) of envelopes exiting an imaging apparatus has not been found. Conventional envelope stackers have shown to be deficient in accomplishing this task. For example, when envelopes are stacked in a simple catcher box as shown in FIG. 1, they tend to fall sideways. This is because the envelope flap is slightly open and also forms three paper thicknesses on the same side which creates an unstable medium to stack. Also, individual envelopes alone are much more variable from style to style than paper, i.e., some stack better or worse than others. In addition, prior art stackers do not address the problem of the desirability of stacking envelopes 1—N which would make the envelope match documents printed and stacked 1—N. Simple catch boxes, as for example, in FIG. 1, which most low capacity stackers employ, are N—1 stackers, so that the user must perform a very tedious manual inversion of the envelopes in order to make the envelope printing order match the letter order that must be inserted into the envelopes. Therefore, if possible, the imaged or addressed side of envelopes should be stored 1 to N as shown in FIG. 2.

An object of the present invention is to provide a simple and cost effective envelope stacker.

Therefore, the present invention provides a high capacity envelope stacker that comprises a bin for receiving envelopes exiting an imaging apparatus short edge first and in a flat configuration. Afterwards, each envelope is rotated 90° so that the imaged envelopes are stored 1—N on either of their long edge axes and are pushed into an adjacent storage area where they can be easily accessed and collected.

Figure 1:
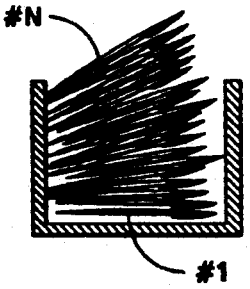
FIG. 1 PRIOR ART
FIG. 1 is a partial side view of a prior art envelope stacker.
Figure 2:
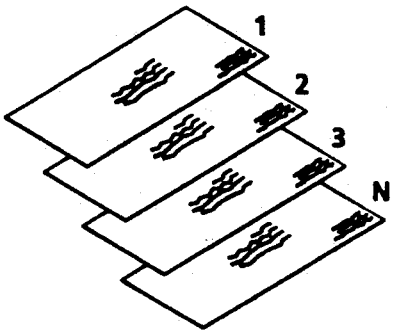
FIG. 2 is an exploded schematic showing envelopes stacked in 1—N order.

Referring now to the drawings in detail, and wherein like numbers indicate like elements, high capacity envelope stacker apparatus 100 is shown attached to an envelope feeding copier/printer, such as shown in U.S. Pat. No. 5,139,250, by John D. Zoltner and entitled OSCILLATING BLADE ENVELOPE ROTATOR, patented Aug. 18, 1992 which is incorporated herein by reference to the extent necessary to practice the present invention.

The high capacity envelope stacker apparatus 100 of the present invention is used only part of the time an imaging apparatus, such as, a printer is in use. As such, it must be compact and unobtrusive from an appearance standpoint, and since it is not a dedicated part of the imaging apparatus, it must be inexpensive.

Figure 3:
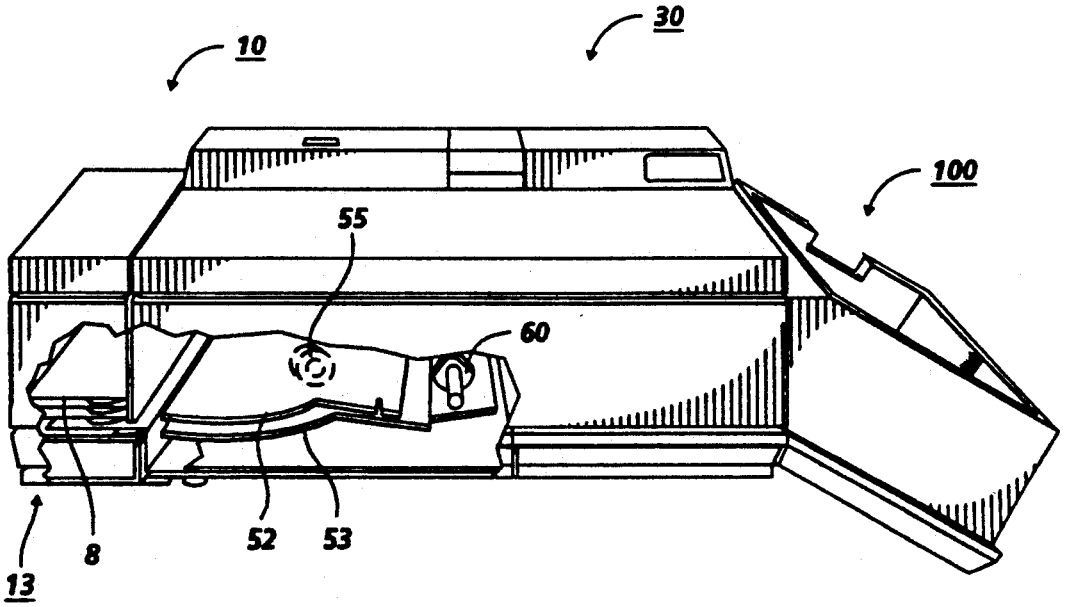
FIG. 3 is a schematic front view of the high capacity envelope stacker apparatus of the present invention attached to a conventional copier/printer.

Such an envelope stacker is shown in FIG. 3 as 100 connected to an exemplary printer 30, such as the Xerox 4045 ®, that includes an envelope feeder 10. Envelope feeder 10 is a high capacity (200 envelopes), gravity-fed, load-while-run (when a cover safety interlock is not used) apparatus which is adapted to be connected to a printer with a long dimension of the envelopes 8 placed against the end and short edge dimension of the printer for minimum footprint usage. The envelopes are inserted flap down within walls of bin 13. A planar bottom and envelope supporting portion of the bin has a relieved portion therein the shape of an envelope flap that permits the flap of the lowermost envelope to extend thereinto. A motor and brackets support a picker blade by way of a shaft (not shown) for back and forth or oscillatory movement within a predetermined space along the bottom surface of bin 13. On demand, the blade (not shown) is rotated by the motor from a first or home position underlying bin 13 to a second position within printer 30. The picker blade sweeps each envelope sideways and pivots them from a short edge dimension to a long edge dimension within the printer between guides 52 and 53. Each envelope is then registered along its long edge with scuffer wheel 55 and fed out of the printer by feed rolls 60 into high capacity envelope stacking apparatus 100.

Figure 4:
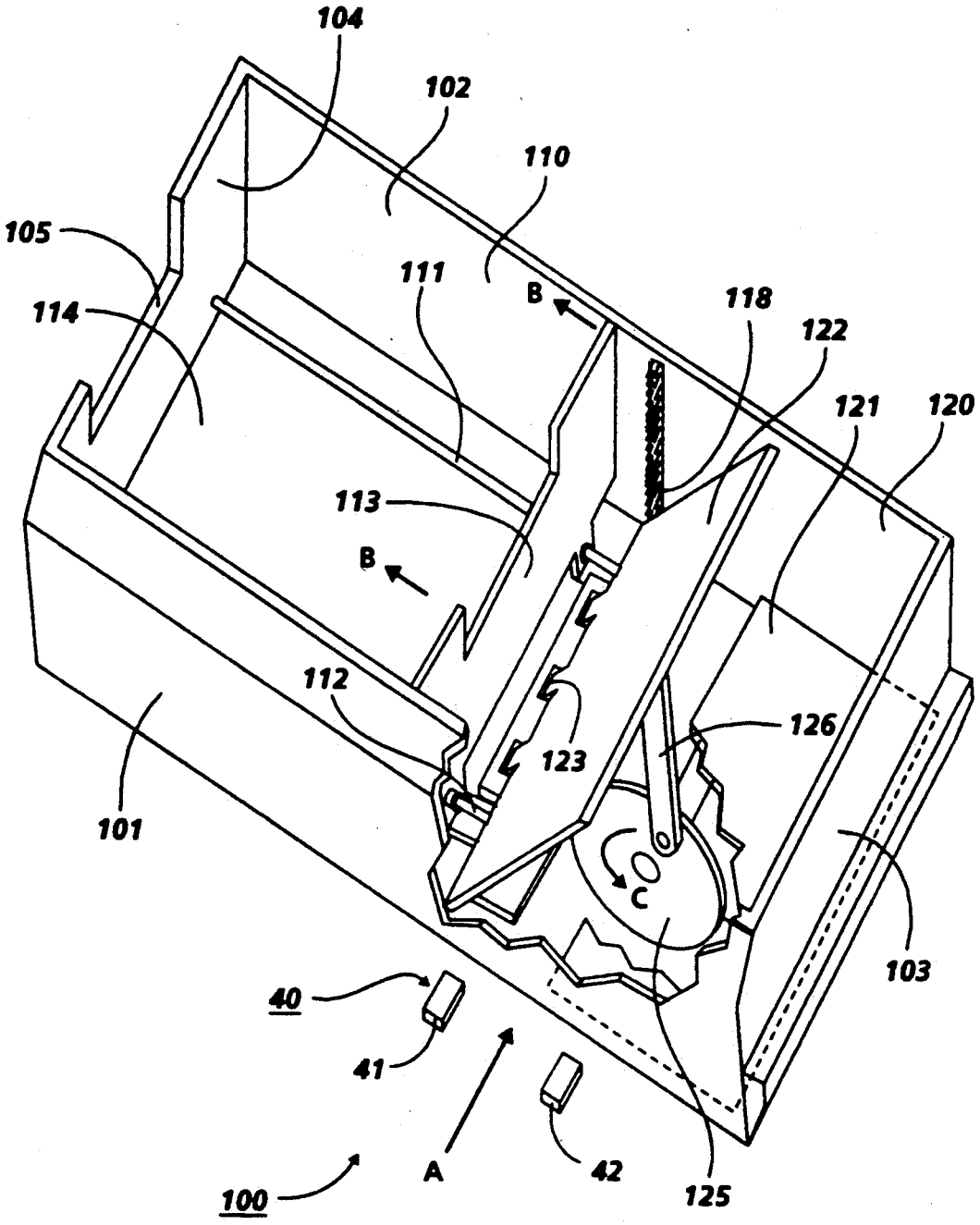
FIG. 4 is a partial, schematic isometric view of the high capacity envelope stacker apparatus of FIG. 3 showing the envelope flipping member actuated.
Figure 5:
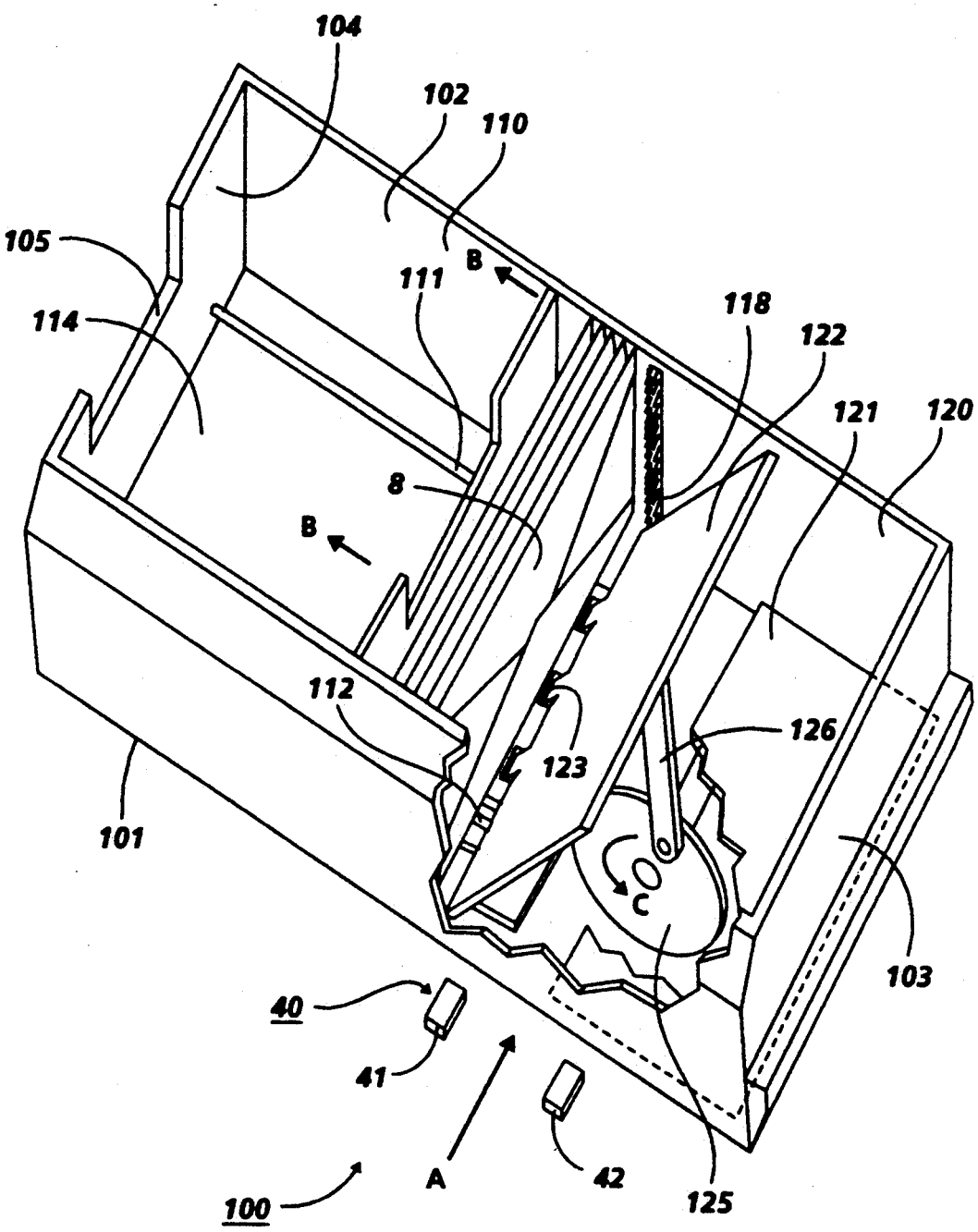
FIG. 5 is a partial, schematic, isometric view of the high capacity envelope stacker apparatus of FIG. 3 with envelopes that have been flipped onto one of their long edges.

High capacity envelope stacker 100 of the present invention in FIGS. 3–5 accepts envelopes from copier/printer 30 at about a 30° angle and comprises a catch tray having side walls 101 and 102 and end walls 103 and 104 with the catch tray being divided into an envelope receiving compartment 120 and an envelope storage compartment 110 by snubbers 118. Compartment 120 has a bottom shelf 121 and compartment 110 has a slidable partition 113 positioned to slide along rods 111 and 112 away from snubbers 118 toward end wall 104 as envelopes fill compartment 110. Brush-like snubbers 118 are positioned on opposite sides of walls 101 and 102 to delimite compartments 110 and 120, that is, compartment 120 ends at one side of snubbers 118 and compartment 110 starts at the other side of snubbers 118 and for reasons that will be explained hereinafter. A movably pivoting flipper plate 122 is positioned within compartment 120 and mounted by hinge 123 to be rotated through an arc of 90° from a position on top of bottom receiving shelf 121 past snubbers 118 by an actuator disc 125 driven by a motor (not shown). Actuator disc 125 is connected to pivoting flipper plate 122 by an eccentrically mounted link 126.

In operation, envelopes exit the output or right end of copier/printer 30 as viewed in FIG. 3, at an angle of approximately 30° in the direction of arrow A of FIG. 4 and are received in receiving compartment 120 and coming to rest on flipper 122. Envelopes pass a photosensor 40 in the exit path of copier/printer 30 which includes an emitter 41 and a detector or receiver 42. The software of copier/printer 30 is designed such that a signal from sensor 40 that an envelope has passed that station is sent to the onboard computer of the copier/-printer. After a predetermined delay, to allow the envelope to come to rest in the stacker on flipper plate 122, a signal is sent from the computer to actuate the motor that turns actuator disc 125 one revolution. This acts on link 126 which pivots flipper plate 122 90°. Flipper plate 122 in turn rotates the envelope thereon 90° past brush snubbers 118 until the envelope is captured between the brush snubbers and slidable partition 113. As this operation is repeated for each individual envelope, slidable partition 113 moves in the direction of arrows B to the left of FIGS. 4 and 5 in small incremental steps so that a force to sufficiently orient the envelopes vertically (on a long edge dimension thereof) is always maintained. After a run is completed, the operator pushes the partition further to the left, grasps the stack of envelopes with one hand extending through relieved or cut-out area 105 and the other at the exposed end of the envelopes adjacent brush snubbers 118 and pulls them from the storage compartment for deposit in another area. Slidable partition 113 is then manually returned to the extreme right end of the storage compartment adjacent brush snubbers 118. It should be understood that a spring could be used to automatically return the slidable partition to this home position, if desired.

The resultant stacked envelopes from this operation are stacked (image side) 1—N which is the desired sequence since copy sheets that are to be inserted into the envelopes are usually stacked 1—N. The advantages of this stacker apparatus over prior envelope stackers include the 1—N order integrity; low-complexity; low unit manufacturing cost; user friendliness and safe operation.

Figure 6:
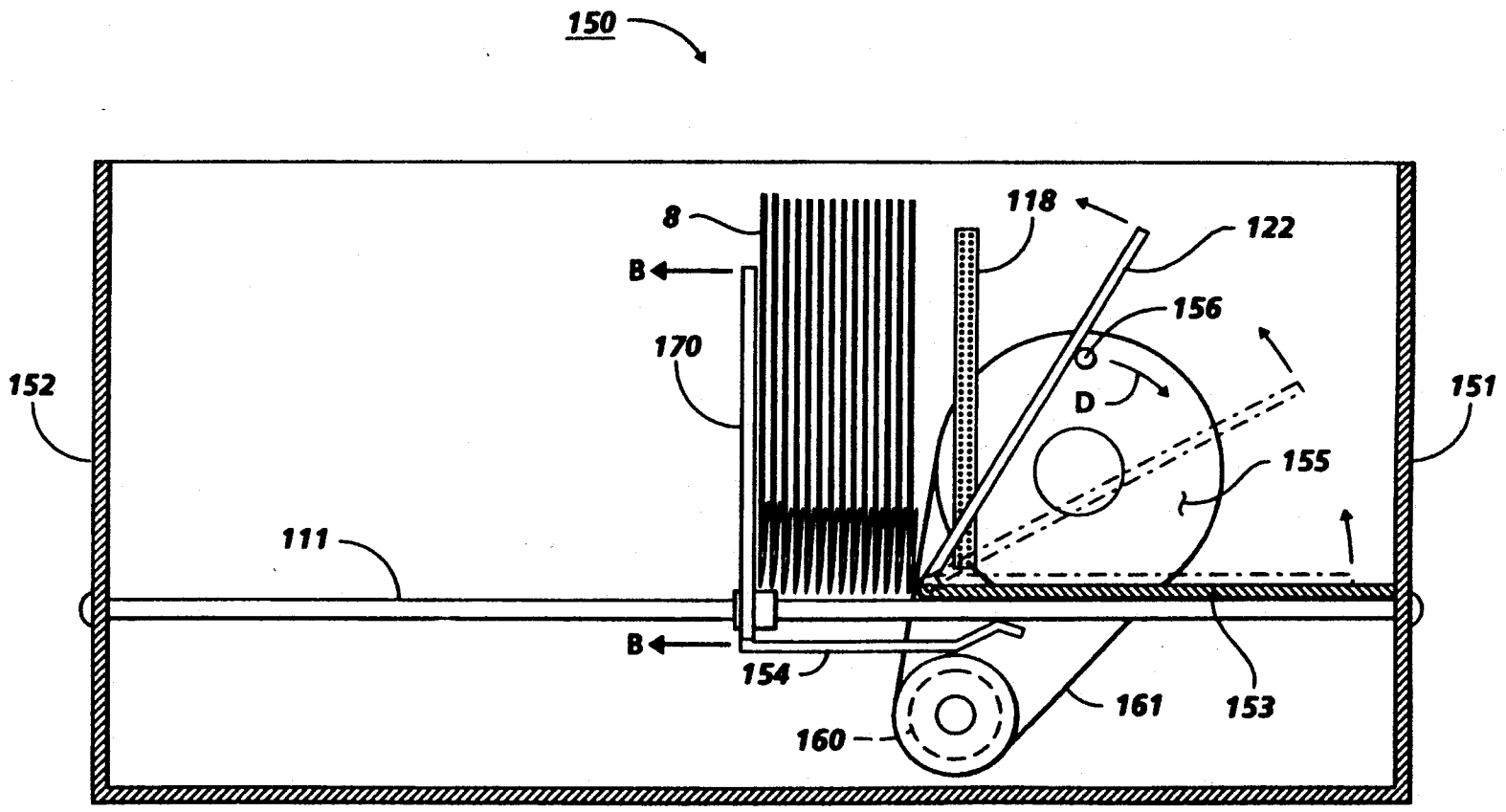
FIG. 6 is a partial, schematic side view of an alternative embodiment of the high capacity envelope stacker apparatus of the present invention.
Figure 7:
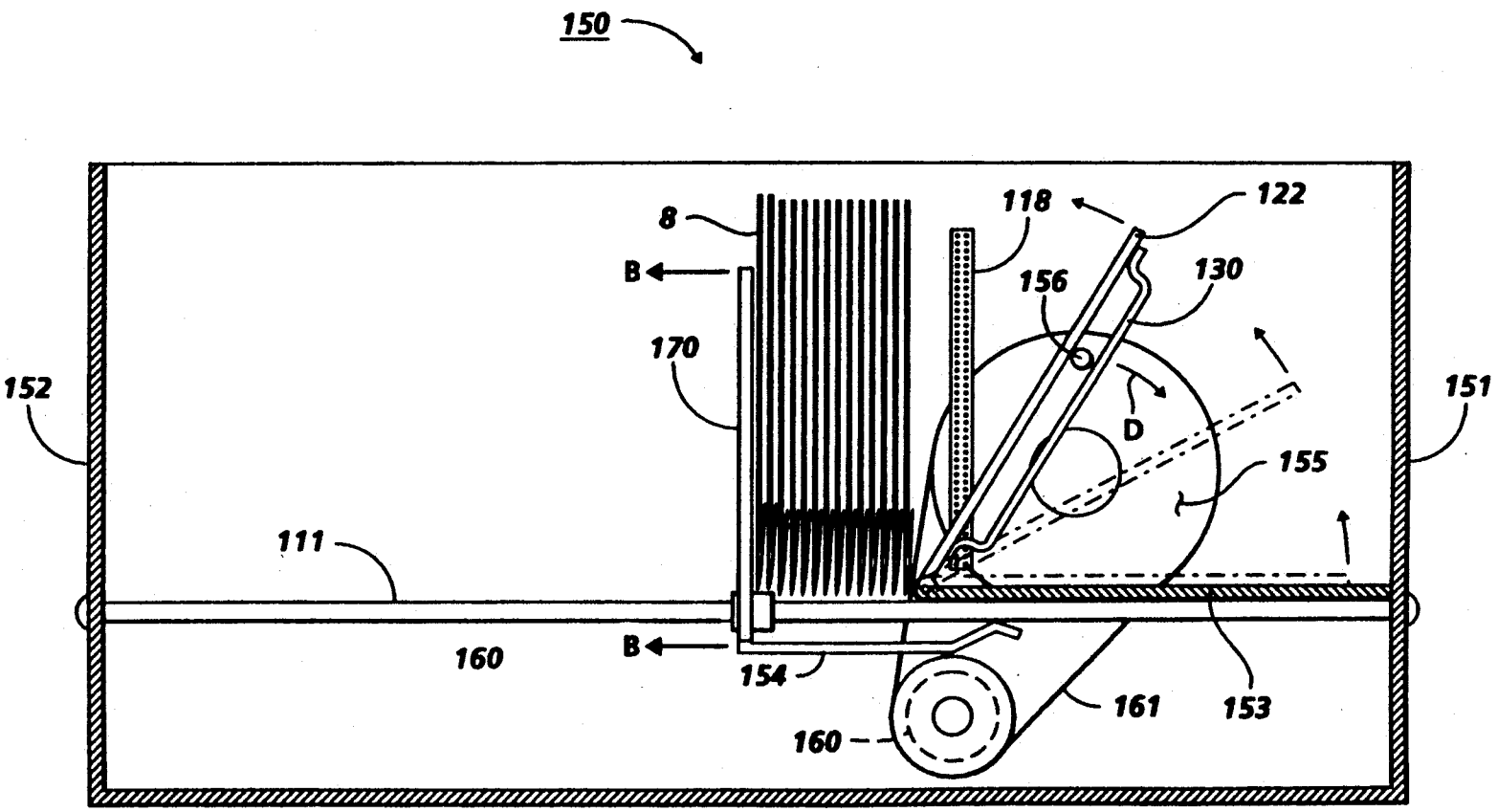
FIG. 7 is a partial, schematic side view of another alternative embodiment of the high capacity envelope stacker apparatus of the present invention showing a captive pin for rotating the flipper plate.

An alternative embodiment of the high capacity envelope stacker in accordance with the present invention is shown in FIGS. 6 and 7 in which like numbers represent like elements of FIGS. 3-5. In FIG. 6, envelopes 8 enter stacker 150 and rest flap side down on top of flipper plate 122 which is parallel to bottom shelf 153. When motor pulley 160 is actuated by a signal from the stacker logic circuit (not shown), disc 155 is rotated by belt 161 in the direction of arrow D for one revolution for each envelope and pin 156 that is attached to disc 155 lifts flipper plate 122 which is spring loaded down and envelope 8 past brushes 118 onto a long edge thereof and against stopper plate 170. As the process continues for each incoming envelope, the action of flipper plate 122 pushes the envelopes and movable support 154 along rails or tubular slides 111 in the direction of arrows B toward end member 152 and away from end member 151. The stacker apparatus of FIG. 7 is the same as that shown in FIG. 6 except that pin 156 is shown captured within a bracket 130 connected to the underside of flipper plate 122. As a result, rotation of disc 155 causes pin 156 to ride within bracket 130 to thereby raise and lower flipper plate 122 in order to stack incoming envelopes.

Having thus described the invention, it is obvious that various immaterial modifications may be made in the same without departing from the spirit and scope of the invention: hence, it is intended to be understood as limiting the invention to the exact form, construction, arrangement, and combination of parts herein shown and described uses mentioned.

What is claimed is:

1. An envelope stacker apparatus, comprising:

a catch tray with said catch tray being divided into a receiving compartment for receiving envelopes flap side unexposed, individually from a source and supporting each envelope in a first substantially non-vertical position and a storage compartment for storing the envelopes in a stack in a second vertical position with the last envelope in the stack having its flap side exposed; said catch tray being positioned orthogonal to said source in order to receive each envelope short edge dimension first; and wherein said receiving compartment includes means for moving each envelope individually from said first position to said vertical position long edge dimension first.

2. The envelope stacker apparatus of claim 1, including slidable partition means for movement within said storage compartment, and wherein said slidable partition means is mounted on rails and adapted to be pushed incrementally along said rails by said means for moving the envelopes from said first position to said vertical second position as the envelopes are moved individually and separately from said receiving compartment to said storage compartment.

3. The envelope stacker apparatus of claim 2, wherein said means for moving the envelopes from said first substantially non-vertical position to said vertical second position includes a pivotable flipper plate, said flipper plate being connected to an actuator disc such that each revolution of sid disc lifts said flipper plate from said first position to a vertical position with said flipper plate returning to said first position due to gravity.

4. The envelope stacker of claim 1, wherein said catch tray is adapted to individually convert each envelope entering said catch tray from a horizontal to a vertical position before removal therefrom by an operator.

5. An envelope stacker apparatus, comprising:

a catch tray;

means dividing said catch tray into a receiving compartment and a storage compartment, said receiving compartment being adapted to receive envelopes short edge dimension first and said storage compartment being adapted to receive envelopes long edge dimension first; and means for individually and separately converting envelopes after each envelope is received in said receiving compartment from an initial horizontal position to a substantially vertical position and individually stacking them in said storage compartment and forming a stack of 1—N envelopes.

6. The envelope stacker apparatus of claim 5, including slidable partition means for supporting the envelopes in said substantially vertical position, said slidable partition means is mounted on rails and adapted to be pushed incrementally along said rails by said means for moving the envelopes from said initial horizontal position to said substantially vertical position.

7. The envelope stacker apparatus of claim 6, wherein said means for moving the envelopes from said initial horizontal position to said substantially vertical position includes a pivotable flipper plate, said flipper plate being connected to an actuator disc such that each revolution of said disc lifts said flipper plate from a first position holding each envelope in said horizontal position to said vertical position in order to position the envelopes in 1—N order.

8. A printer adapted to print images onto envelopes, comprising:

an imaging apparatus;

an envelope feeder adapted to feed envelopes after they have been imaged by said imaging apparatus; and a catch tray positioned orthogonal to said printer and adapted to receive each envelope short edge dimension first from said feeder with said catch tray being divided into a receiving compartment for receiving envelopes from said imaging apparatus short edge dimension first and supporting them in a first substantially non-vertical position and a storage compartment for storing the envelopes in a stack in a second substantially vertical position; and wherein said receiving compartment includes means for moving the envelopes long edge dimension first from said first position with a flap side of each envelope being unexposed to said vertical position wherein said flap side of the last envelope in the stack is exposed.

9. The printer of claim 8, including slidable partition means adapted for sliding movement within said storage compartment, and wherein said slidable partition means is mounted on rails and adapted to be pushed incrementally along said rails by said means for moving the envelopes from said first position to said vertical second position.

10. The printer of claim 9, wherein said means for moving the envelopes from said first position to said vertical second position includes a pivotable flipper plate, said flipper plate being connected to an actuator disc such that each revolution of said disc lifts said flipper plate from said first position to a vertical position with said flipper plate returning to said first position due to gravity.

* * * * *